United States Patent [19]

Weyn

[11] 3,935,973

[45] Feb. 3, 1976

[54] AEROSOL SPRAY CONFINING DEVICE

[75] Inventor: Hendrik Frans Weyn, Le Chesnay, France

[73] Assignee: Colgate-Palmolive Company, New York, N.Y.

[22] Filed: Nov. 18, 1974

[21] Appl. No.: 524,511

[30] Foreign Application Priority Data

Dec. 19, 1973 France ..... 73.45479

[52] U.S. Cl. ..... 222/182; 222/402.12; 239/288.5

[51] Int. Cl.[2]... B67D 5/06; B05B 1/28; B05B 15/04

[58] Field of Search..... 239/288, 288.3, 288.5; 222/182, 402.12

[56] References Cited

UNITED STATES PATENTS

| | | | |
|---|---|---|---|
| 3,157,321 | 11/1964 | O'Donnell | 239/288 |
| 3,172,607 | 3/1965 | Riuli et al. | 239/288 |
| 3,260,465 | 7/1966 | Grumbein | 239/288.3 |
| 3,648,885 | 3/1972 | Kitsuda | 222/182 |
| 3,756,514 | 9/1973 | Brown | 239/288.5 |
| 3,841,533 | 10/1974 | Carroll et al. | 239/288.5 |
| 3,854,632 | 12/1974 | Smrt | 222/182 |

*Primary Examiner*—Lloyd L. King
*Attorney, Agent, or Firm*—Herbert S. Sylvester; Murray M. Grill; Norman Blumenkopf

[57] ABSTRACT

A device for confining an aerosol spray containing a deodorant or antiperspirant to the axilla area, including a tubular shield which is separably coaxially coupled to the spray end of an aerosol container provided with an axially directed spray nozzle and a depressible valve actuating lever. An opening is formed in the proximate section of the shield to provide finger access to the valve actuator. The edge of the discharge end of the shield may be contoured to mate a corresponding border of the axilla area and the proximate borders of the shield may be shaped to engage aerosol containers of various configurations.

7 Claims, 5 Drawing Figures

AEROSOL SPRAY CONFINING DEVICE

The present invention relates generally to improvements in spray devices, and more particularly to an improved shield device for use with aerosol containers for confining the application of the dispensed material to a selected area.

It is a common practice to dispense many products from aerosol containers to facilitate application of the products. Among the products which can be so applied are, for example, antiperspirants and deodorants which are normally in a liquid or solid particulate state, and which are dissolved or dispersed in a finely divided condition in a highly volatile propellant, such as many of the fluorinated hydrocarbons as typified by the Freons. While the aerosol dispensing and the topical application of a product such as an antiperspirant or deodorant to parts of the body, particularly to the armpit or axilla, are highly convenient, with the usual aerosol method of topical application overspray generally occurs. This is both highly inefficient and wasteful. In addition, a proportion of the efficacy of the product may be lost due to "bounce-off."

Accordingly, among the principal objects of the present invention is to provide an improved, packaged aerosol container provided with a shield device for minimizing or obviating overspray.

Still another object of the present invention is to provide an improved shield device for use with conventional aerosol containers for confining the application of the sprayed product to a desired area.

A further object of the present invention is to provide an improved shield device for confining an aerosol spray to the axilla area.

Still a further object of the present invention is to provide a device of the above nature characterized by its high efficiency and reliability, ease and convenience of use and great versatility and adaptability.

The above and other objects of the present invention will become apparent from a reading of the following description taken in conjunction with the accompanying drawing which illustrates preferred embodiments thereof.

The present invention contemplates the provision of a combination including an aerosol container having an axially directed discharge nozzle and a valve actuating member, and a tubular shield supported by and extending coaxially from the container. The shield communicates with the nozzle and has a discharge opening at its distal end of greater diameter than the nozzle, the actuating element being accessible for finger operation in the presence of the shield.

In the preferred form of the shield, it is of cylindrical tubular configuration, is separably coupled to the nozzle end section of the container, and is provided in its proximate border with an opening affording finger access to the valve actuating member. Advantageously, the edge of the shield at its distal or spray discharge end is contoured to match a corresponding border area of the axilla. Where the aerosol container is of the type provided with a tapered upper peripheral wall, the tubular shield terminates in a depending sleeve which resiliently tightly engages the container cylindrical wall and includes an inwardly directed annular rib which rests on the container wall tapered section to prevent telescoping movement between the container and shield member after assembly. Where the container is of the type having an annular bead along the top edge of its peripheral wall, the shield member terminates at its proximate end in an outwardly offset depending curved lip which separably engages the bead outer periphery, or in an inwardly directed annular lip which releasably engages the inner under face of the bead.

The improved aerosol spray shield device is simple, rugged, convenient, inexpensive and of low cost, and is highly effective and efficient in restricting the incidence of an aerosol spray to a desired area and in minimizing overspray.

Figure 1:
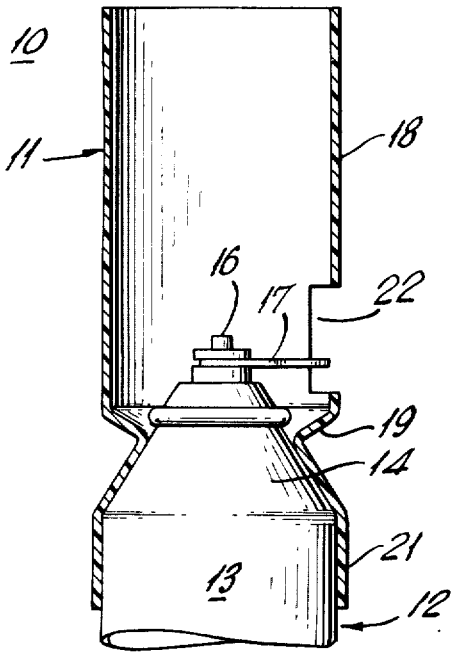
FIG. 1 is a fragmentary side elevational view, partially in section, of a preferred embodiment of the present invention.
Figure 2:
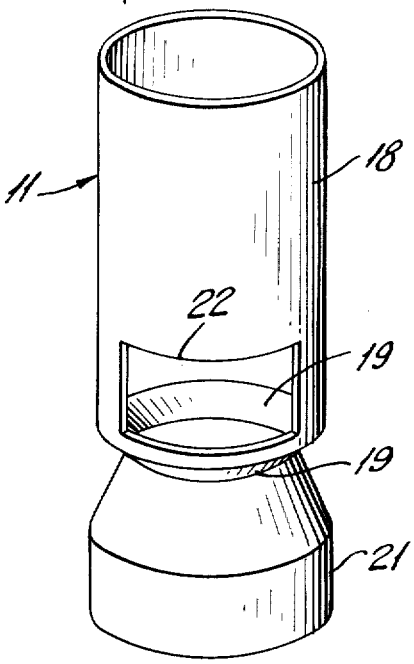
FIG. 2 is a front perspective view of the spray shield member thereof.

Referring now to the drawings, and particularly FIGS. 1 and 2 thereof which illustrate a preferred embodiment of the present invention, the reference numeral 10 generally designates the improved aerosol spray device which includes a shield member 11 and a loaded aerosol container 12 of substantially conventional construction. The aerosol container 12 is of the type which includes a cylindrical peripheral wall 13, the upper part 14 of which is upwardly and inwardly tapered. Closing the top of the container 12 is an end wall on which is mounted an upwardly directed axial nozzle 16, which communicates in known fashion through a normally closed valve and tube with the bottom interior of the container 12. A valve actuating member or element in the form of a lever 17 extends radially from the aerosol valve, the depression of the outer end of the lever 17 effecting the opening of the valve. The container 12 is charged with a highly volatile propellant, such as Freon, having dissolved or dispersed therein any suitable composition, such as an antiperspirant or deodorant.

The shield member 11 is of tubular configuration and is integrally formed of any suitable resilient material, preferably a synthetic organic polymeric resin, such as polyethylene, polypropylene, polyvinyl chloride or the like, and may be produced in any suitable manner, such as by injection molding. The upper wall or shield section 18 of shield member 11 is advantageously of circular cylindrical configuration and of a diameter approximately equal to or slightly greater than that of the container wall 13. Formed in the bottom border of cylindrical wall 18 is an annular, inwardly directed rib 19 having a bottom inside face 20 mating with the lower border of the tapered container wall 14. Depending from the bottom of the rib 19 is a cylindrical skirt wall 21 having an inside diameter approximating the outside diameter of container wall 13.

Formed in the lower part of the shield wall 18 is a rectangular opening of a size affording convenient finger access to the upper face of the valve actuator lever 17 when the shield member 11 and container 12 are in assembled condition. The upper or distal discharge end opening of shield 18 is advantageously about 3 to 4 inches above the lever 17 when the device 10 is in assembled condition.

In employing the aerosol spray device, the shield member 11 is releasably coupled to the container 12 by axially sliding the lower part of the shield member 11 over the upper end of the container 12 until the rib underface 20 bears on the container tapered section 14, as shown in FIG. 1, with the opening 22 medially registering with the actuator lever 17. In the above condition, the skirt wall 21 snugly, separably and slidably hugs the container wall 13.

The upper edge of the shield member is then pressed against the axilla surface to effect a close engagement therewith and the lever 17 is depressed by access through opening 22 so that an aerosol spray is axially directed from the nozzle 16 onto the axilla area. The shield member 11 prevents or minimizes the dispersion of the propellant carried materials outside of the desired region, the evaporated propellant escaping through opening 22 or other small openings which optionally may be provided in the proximate end of shield wall 18, for example, in the upper section of rib 19. By reason of the configuration of the aerosol spray, the wall attraction affect, and the pattern of the material carried by the propellant, the active ingredients concentrate in the area of the shield discharge opening and the expanded propellant escapes rearwardly substantially free of the carried material.

After use, the assembled device 10 may be stored as such, or it may be contracted by removing the shield member 11 from the container 12, inverting the shield member 11 and sliding it over the container 12 with the wall shield wall extending downwardly, the lever 17 being protected by the portion of the shield member projecting above the rib 19, including skirt wall 21.

Figure 3:
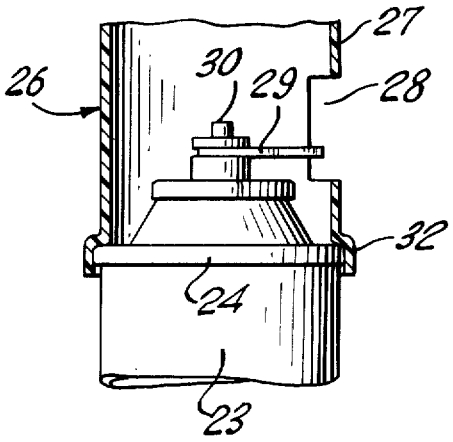
FIG. 3 is a fragmentary view similar to FIG. 1 of another embodiment of the present invention.
Figure 4:
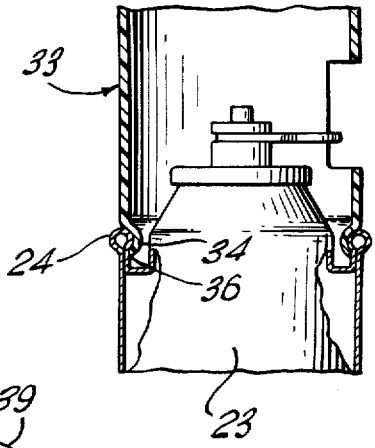
FIG. 4 is a view similar to FIG. 3 of still another embodiment of the present invention.

The embodiments of the present invention shown in FIGS. 3 and 4 differ from that first described in the type of aerosol container employed and the corresponding modifications of the shield member to permit its separable coupling to the container. Specifically, in both embodiments, the aerosol container 23 is of the type including a cylindrical peripheral wall provided at its top with a peripheral bead 24.

In the embodiment illustrated in FIG. 3, the shield member 26 includes a cylindrical wall 27 corresponding to shield wall 18 and having an opening 28 in its lower border providing access to the valve actuating lever 29 of the axially upwardly directed nozzle 30. Depending from the bottom edge of the cylindrical wall 27 is an outwardly offset annular lip 32, slightly concave on its inside face and having an inside diameter slightly less than the outside diameter of the bead 24. The lip 32 is delineated from the wall 27 by a downwardly facing annular shoulder.

The shield member 26 is coupled to the container 23 merely by snap fitting the lip 32 onto bead 24 and in all other respects and in operation the device 26 is similar to the device 10.

The embodiment shown in FIG. 4 differs from that shown in FIG. 3 only in that the coupling effected between the shield member and the aerosol container is by way of the inner under surface of aerosol container bead 24. The shield member 33 is provided at its bottom with a depending inwardly offset coaxial annular flange 34 having a concave outer face and terminating at its bottom in an outwardly directed peripheral lip 36. In assembling the container 23 and the shield member 33, the shield member is coaxially pressed downwardly on the container 23, the upper inside face of the bead 24 cams the lip 36 inwardly until the lip is lowered below the inner periphery of the bead 24 and the lip 36 is then resiliently urged outwardly to firmly engage the underface of the inner section of the bead 24.

Figure 5:
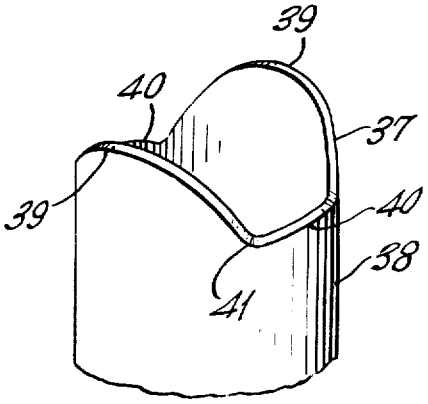
FIG. 5 is a fragmentary perspective view of the distal section of the shield member of a further embodiment of the present invention.

While in the embodiments of the invention described above, the upper edge of the shield member surrounding the discharge opening is shown as circular and planar, such edge may advantageously be contoured to conform to or mate with the surface of the axilla along a line of intersection with the shield cylindrical wall, thereby providing a better seal between the shield member and the axilla surface with less pressure. Thus, for example, as shown in FIG. 5 of the drawing, the top edge 37 of the shield member 38 is of undulate configuration, the shield member 38 being otherwise of the same construction as the shield members earlier described. The undulate edge 37 is shown as including a first pair of diameterically opposite, relatively high curved ridges 39 and a second pair of relatively flat edges 40 arranged in quadrature with ridges 39 and being separated therefrom by intervening corners 41. The edges 37 are advantageously rounded and inwardly curved. The use of the aerosol spray device having the contoured edge 37 is similar to that of the earlier described devices except that the shield 38 should be properly oriented about its axis so that the edge 37 is in mating engagement around the axilla surface.

While there have been described and illustrated preferred embodiments of the present invention, it is apparent that numerous alterations, omissions and additions may be made without departing from the spirit thereof.

What is claimed is:

1. In combination, an aerosol container having a peripheral wall and an axially directed discharge nozzle and a valve actuating element comprising a lever extending radially from said valve at a common end of said container, said nozzle communicating with the bottom interior of said container through a normally closed valve and tube and a tubular shield supported by and extending coaxially from said container and separably coupled thereto and communicating at its proximate end with said nozzle, and having a discharge opening at its distal end of diameter approximately equal to or slightly greater than that of said container peripheral wall, said valve actuating element being accessible for finger operation by means of an opening formed in the lower part of said shield.

2. The combination of claim 1 wherein the upper portion of the peripheral wall of said container is upwardly inwardly tapered and said shield is provided with an inwardly projecting ridge bearing on the tapered section of said container wall, and a depending sleeve extending below said tapered section tightly resiliently engaging the peripheral wall of said container.

3. The combination of claim 1 wherein said peripheral wall is provided with an outwardly projecting upper annular bead and said shield terminates at its proximate end in a depending outwardly offset peripheral lip which tightly resiliently engages the outer periphery of said bead.

4. The combination of claim 1 wherein said peripheral wall is provided with an upper annular bead having a downwardly facing inner shoulder and said shield terminates at its proximate end in an outwardly directed annular lip resiliently engaging said shoulder.

5. The combination of claim 1 wherein the peripheral edge of the distal end of said shield has a contour complementary to that of the axilla delineated by the intersection of the axilla with said distal end of the shield.

6. The combination of claim 5 wherein the peripheral edge of the distal end of said shield is of undulate configuration including a first pair of diametrically opposite, relatively high curved ridges and a second pair of relatively flat edges arranged in quadrature, said ridges being separated from said flat edges by intervening corners.

7. In combination, an aerosol container having a peripheral wall and an axially directed discharge nozzle and a valve actuating element comprising a lever extending radially from said valve at a common end of said container, said nozzle communicating with the bottom interior of said container through a normally closed valve and tube, and a tubular shield supported by and extending coaxially from said container and separably coupled thereto and communicating at its proximate end with said nozzle and having a discharge opening at its distal end of diameter approximately equal to or slightly greater than that of said container peripheral wall, said valve actuating element being accessible for finger operation by means of an opening formed in the lower part of said shield, and wherein the upper portion of the peripheral wall of said container is upwardly, inwardly tapered, and said shield is provided with an inwardly projecting ridge bearing on the tapered section of said container wall and a depending sleeve extending below said tapered section tightly resiliently engaging the peripheral wall of said container.

* * * * *